United States Patent [19]

Lucke

[11] 4,127,978

[45] Dec. 5, 1978

[54] DEVICE FOR PLACING A BAND ON A BALL

[75] Inventor: Florian Lucke, Mengen, Fed. Rep. of Germany

[73] Assignee: Croon & Lucke Maschinenfabrik GmbH & Co. KG, Fed. Rep. of Germany

[21] Appl. No.: 794,994

[22] Filed: May 9, 1977

[30] Foreign Application Priority Data

May 11, 1976 [DE] Fed. Rep. of Germany ..... 2620690

[51] Int. Cl.[2] ..... B65B 13/00; B65B 27/06

[52] U.S. Cl. ..... 53/585; 53/261; 100/9

[58] Field of Search ..... 53/124 E, 198 B, 260, 53/261, 291, 293, 294; 100/9

[56] References Cited

U.S. PATENT DOCUMENTS

| | | | |
|---|---|---|---|
| 1,642,894 | 9/1927 | Rober | 53/198 B |
| 2,026,284 | 12/1935 | Metternich | 53/198 B |
| 2,561,271 | 7/1951 | Gould | 53/198 B X |
| 2,713,449 | 7/1955 | Carmichael | 53/261 X |
| 2,884,328 | 4/1959 | Johnson | 53/261 X |
| 2,933,866 | 4/1960 | Cranston, Jr. | 53/198 B X |
| 3,313,090 | 4/1967 | Kerrigan | 53/198 B X |
| 3,774,367 | 11/1973 | Lerner | 53/261 X |

FOREIGN PATENT DOCUMENTS 2244638 3/1973 Fed. Rep. of Germany.

*Primary Examiner*—John Sipos
*Attorney, Agent, or Firm*—Hauke and Patalidis

[57] ABSTRACT

The present invention relates to a device for placing a band on a ball of yarn or the like, wherein the band may be placed on the ball by means of two band carriers displaceable with respect to the ball.

7 Claims, 3 Drawing Figures

DEVICE FOR PLACING A BAND ON A BALL

BACKGROUND OF THE INVENTION

In a known device of this kind, disclosed in German Offenlegungschrift Pat. No. 2,244,638, the band carriers are pivotally installed, being in the form of flaps, and are pre-stressed by means of a spring. A special press-on finger which has co-ordinated with it a reciprocating entraining device, is incorporated to hold the band fast on the flaps.

It is an object of the invention to simplify a device of the kind described and thereby to render the same more reliable in operation.

SUMMARY OF THE INVENTION

In accordance with the invention, this problem is resolved in that the one band carrier is installed displaceably with respect to the other transversely to the band and ball axis, and is reciprocatingly displaceable by means of a power drive. In this embodiment of the band carriers, they need no longer be rotatably journalled, and the special press-on finger holding the band on the band carriers may be omitted.

BRIEF DESCRIPTION OF THE DRAWING

The following description of the preferred forms of embodiment of the invention serves the purpose of disclosing the invention in connection with the accompanying drawings, wherein.

DETAILED DESCRIPTION OF THE PREFERRED EMBODIMENT

Figure 1:
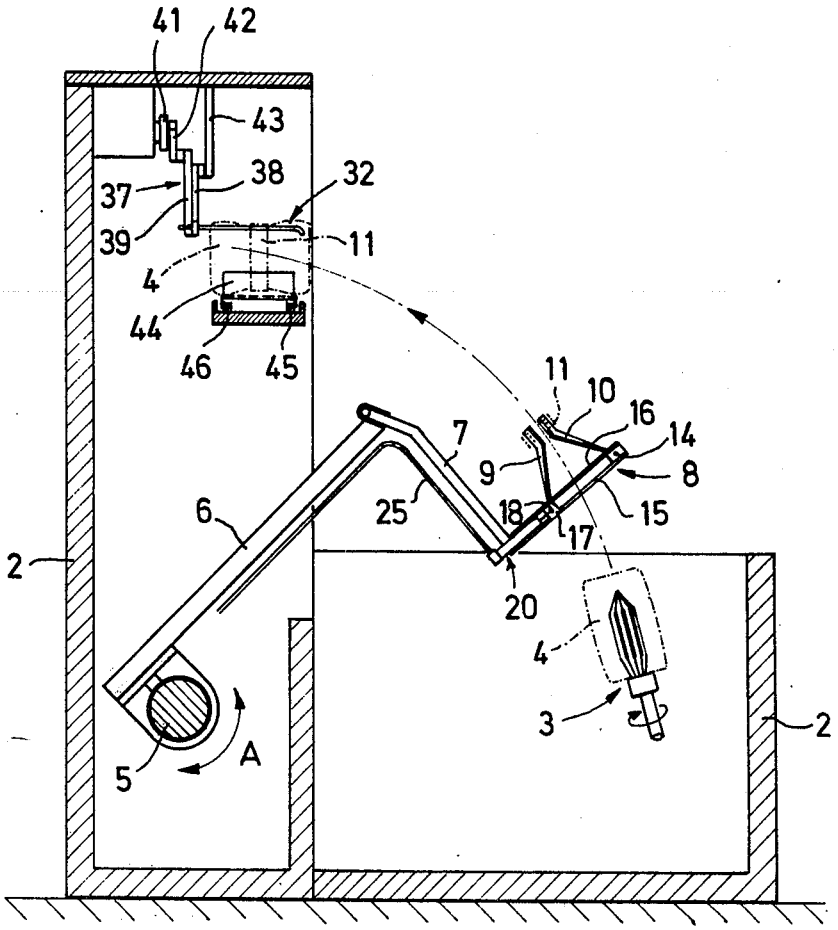
FIG. 1 diagrammatically shows the fundamental structure of a device for the banding of balls.

Referring particularly to FIG. 1, a machine frame 2 serves to mount the elements of the invention. A rotarily entraining winding mandrel 3 whereon a ball 4 of yarn or the like is formed in a known manner, is installed on the machine frame 2 in a manner which is well known and is not illustrated for this reason. The winding mandrel 3 commonly comprises a collapsible lever system situated within the ball 4, which allows a reduction of the mandrel diameter at the appropriate instant to ease the withdrawal of the ball from the mandrel.

An arm 6 is secured on a shaft 5 installed on the machine frame 2 and is pivotable reciprocatingly in the direction of the double-headed arrow A by means of a conventional driving mechanism which is not illustrated. A bracket 7 is positioned at an angle on the free extremity of the arm 6. A supporting arm 8, substantially parallel to the arm 6, projects from the extending end of the bracket 7. A pair of band carriers 9 and 10 for receiving a band 11 which is to be placed on the ball 4, are secured on the supporting arm 8 (FIG. 2).

A first movable band carrier 9 mounted on a rod 18 is positioned opposite a second stationary band carrier 10 mounted on a rod 14.

Figure 2:
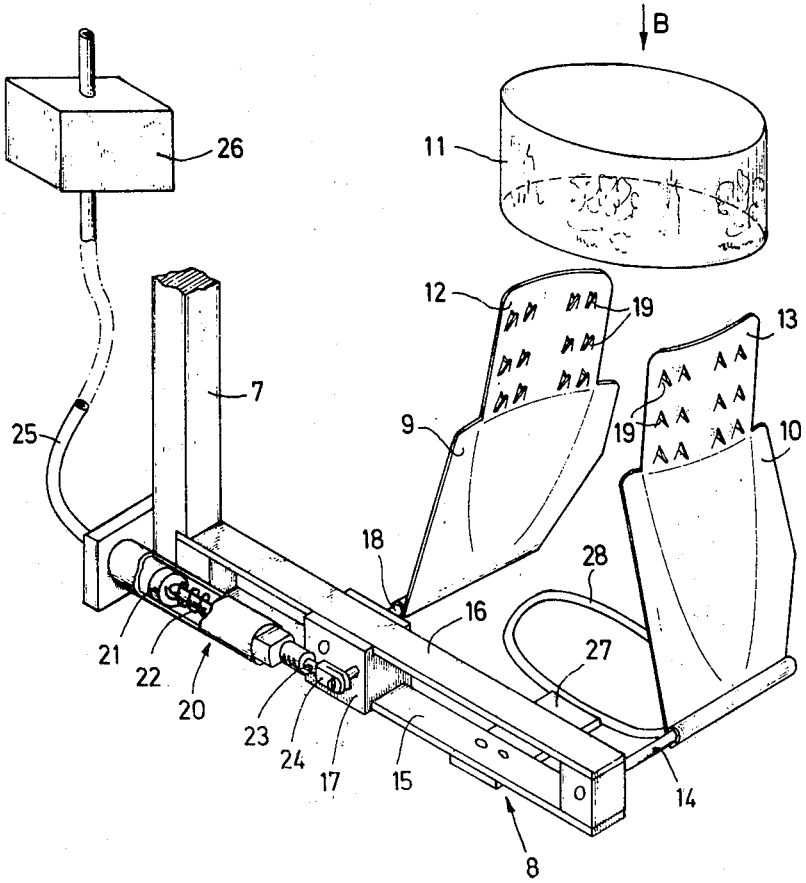
FIG. 2 is a broken perspective view showing structural details of two band carriers and of their drive.

The band carriers 9 and 10, the general shape of which is apparent from FIG. 2, have upper marginal portions 12 and 13, respectively, which comprise elements 19 inwardly directed towards each other and acting as barbs. The band carriers 9 and 10 preferably consist of sheet metal and the elements 19 inwardly directed towards each other are formed by inwardly punched-out prongs equipped with upwardly directed points, analogous to a grater. When the marginal portions 12 and 13 of the band carriers 9 and 10 are pushed over the balls 4 from above, the elements 19 do not oppose any resistance to this pushing-on action. Upon displacement in the opposed direction, the elements 19 however engage the ball 4 and prevent a relative displacement between the band carriers 9 and 10 and the ball 4, so that the same is entrained. The elements 19 act in the manner of true barbs, i.e., they run past the ball 4 practically without friction in the one direction, whereas they grasp and entrain the ball upon displacement in the opposed direction. Since the barb-like elements 19 only project inwards on the band carriers 9 and 10, the laying of the annular band 11 onto the marginal portions 12 and 13 (in the direction of the arrow B in FIG. 2) is not impeded.

The band carrier 10 is rigidly coupled to the supporting arm 8 via the rod 14. The supporting arm 8 (see FIG. 2) comprises two bars 15 and 16 arranged with mutual spacing, rigidly coupled to the bracket 7, which form a sliding guide for a sliding block 17. The band carrier 9 is rigidly fastened on the sliding block 17 by means of the rod 18. A piston-cylinder assembly 20, preferably operated by compressed air, by which the piston 21 is forced back by a return spring 22 into its initial position situated at the left in FIG. 2, is fastened on the bracket 7 and preferably parallel to the supporting arm 8. The piston rod 23 of the assembly 20 is coupled to the sliding block 17 via a coupling element 24. The band carrier 9 is rigidly coupled to the sliding block 17 via the rod 18 and is thereby normally held at a particular distance from the band carrier 10 by the thrust of the return spring 22. Pressure fluid, preferably compressed air, may at times be fed to the assembly 20 by means of a hose 25 and a control valve 26, whereby the piston 21 is displaced towards the right in FIG. 2 against the action of the spring 22 and brings the band carrier 9 closer to the band carrier 10 via the piston rod 23 and the sliding block 17.

A ring of circular or oval shape 28 is held below the band carriers 9 and 10 on the lower bar 15 of the supporting arm 8 by means of a projecting web 27.

Figure 3:
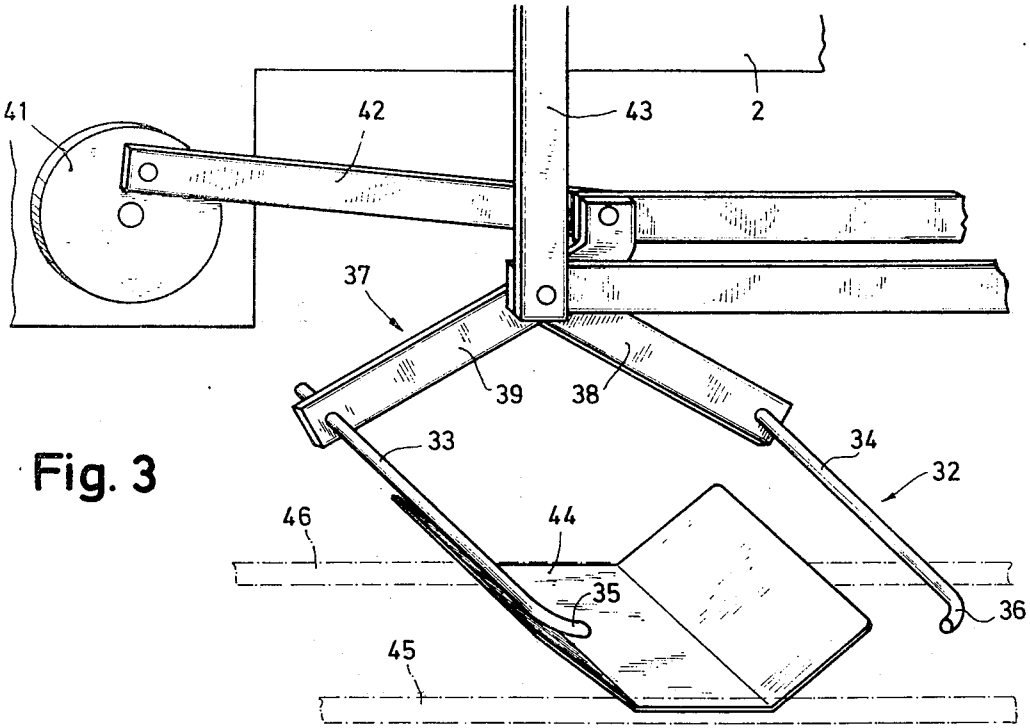
FIG. 3 is a broken perspective view showing a system for removing a banded ball from the band carriers.

Take-off fingers 32, the structure and operation of which is apparent from FIG. 3, are arranged on the machine frame 2 (see FIG. 1). The take-off fingers 32 consist of two rods 33 and 34 having hook-like bent-over extremities 35 and 36 respectively. The rods 33 and 34 are fastened on a scissors linkage 37 comprising limbs 38 and 39 in such manner that, during a displacement of the limbs 38 and 39 of the scissors linkage towards each other, the two rods 33 and 34 equally approach each other. A driven circular plate 41 journalled rotatably on the machine frame 2 which is coupled via a crank rod 42 in equally known manner to the scissors linkage 37 is incorporated in known manner for actuation of the scissors linkage 37. The scissors linkage 37 is secured on the machine frame 2 by means of a support 43. A conveying device equipped with pans 44 which may for example comprise two chains 45 and 46 extending at a distance from each other, or the like, on which the pans are secured, is incorporated below the take-off fingers 32 (see FIGS. 1 and 3).

The form of embodiment of the invention as described operates as follows: during the production of the ball on the winding mandrel 3, the band carriers 9 and 10 are situated in the position illustrated in FIGS. 1 and 2, in which they assume their maximum mutual spacing. The position of the band carrier 9 is concomitantly determined by the return spring 22 which holds the piston 21 in its initial position. The assembly 20 is not acted upon by pressure fluid at this instant. Pressure fluid is thereupon fed into the assembly 20, appropriately controlled by the valve 26, the band carrier 9 thereby being brought closer to the band carrier 10. In this approached position of the band carriers 9 and 10, the band 11 is externally pushed over the upper marginal portions 12 and 13 (in the direction of the arrow B in FIG. 2). After the pushing on of the band 11, the valve 26 cuts off the pressure fluid feed to the assembly 20 so that the return spring 22 again pushes the band carriers 9 and 10 into the position shown in FIG. 2. The band 11 is thereby tensioned and retained on the marginal portions 12 and 13. When the ball 4 is wound completely and the winding mandrel 3 has come to rest, the arm 6 is downwardly pivoted so that the band carriers 9 and 10 are moved forward towards the ball 4. The shaped ring 28 is concomitantly pushed initially over the ball 4 which is appropriately preformed thereby. During continued downward displacement of the arm 6, the band carriers 9 and 10 are pushed over the preformed ball 4, concomitantly threading the bank 11 over the ball 4. The band concomitantly assumes the approximate position of the middle of the longitudinal extension of the ball. After the band has been threaded onto the ball, the assembly 20 is again acted upon by pressure fluid, so that the band carrier 9 travels forward and holds the ball fast between itself and the other band carrier 10. During this mutual approach displacement of the carriers 9 and 10, the band 11 is already firmly seated on the ball 4.

During the then intervening return displacement of the band carriers 9 and 10, which is initiated by upward pivoting of the arm 6, the barb-like elements 19 act on the ball 4 in such a manner that the latter is entrained and pulled off the (collapsed) winding mandrel 3. During continued rearward displacement of the arm 6, the ball 4 held fast by the band carriers 9 and 10 comes within range of the take-off fingers 32 which are then moved sideways towards the ball by displacement of the circular plate 41 and via the scissors linkage 37, the hook-like extremities 35 and 36 of the rods 33 and 34 flanking the underside of the ball. During the intervening and downwardly directed forward displacement of the band carriers 9 and 10, the ball is held fast at its underside by the hook-like extremities 35 and 36 whereas the still close band carriers 9 and 10 are pulled off the ball 4 whilst leaving the band 11 behind on the same, this withdrawal not being impeded by the elements 19 since these are not in action during the forward displacement of the band carriers 9 and 10 because of their barb-like structure. The ball 4 freed from the carriers 9 and 10 then drops off the take-off fingers 32 onto the pan 44 whereby it is carried away to a storage site or the like. After the pressure fluid feed is turned off, the spring 22 carries the band carriers 9 and 10 back into the initial position according to FIGS. 1 and 2.

During the conveying of the ball 4 by the band carriers 9 and 10 to the take-off fingers 32, the rod 33 may enter the space between the band carriers 9 and 10 and the supporting arm 8 because the distance between the band carriers 9 and 10 and the supporting arm 8 is relatively large. Both rods 33 and 34 may thus be placed in direct contact with the bank 11 and thrust the same firmly against the ball 4, so that the band is held fast at its prescribed place on the ball during the withdrawing displacement of the band carriers 9 and 10.

In the inventive form of embodiment described, the reciprocating displacement of the band carriers 9 and 10 is performed by pivoting the arm 6 by means of the shaft 5. This pivotal displacement may be replaced by one versed in the art by a sliding displacement with a guiding slideway. In the preferred form of embodiment of the invention, several arms 6 equipped with band carriers 9 and 10 are secured side-by-side on the shaft 5 of the machine frame 2 and each arm 6 has coordinated with it take-off fingers 32 according to FIG. 3 and a winding mandrel 3 according to FIG. 1. In this manner, several balls 4 may be produced, banded and pulled off the winding mandrels 3 at the same time.

Entraining and controlling devices are incorporated in the inventive device, in particular also for the valve 26, which in each case initiate and terminate the displacements of the winding mandrel 3 of the shaft 5 of the band carrier 9 of the circular plate 41, etc., at the correct time. Such entraining and controlling devices are known per se, so that they need not be described in particular in this case.

The bands are of different (peripheral) length depending on the volume of the yarn wound into the ball. The band carriers 9 and 10 always had to be adjusted accordingly before hand for this reason, in the case of known banding devices. This is no longer necessary in the inventive device, because of the return spring 22. The bands 11 are always held fast securely even in case of different lengths.

Because of the shaped ring 28, it is possible to perform a tighter banding operation (by means of shorter bands) because the ring 28 preforms, i.e., compresses the ball 4. Beyond this, the thread or yarn end is firmly laid against the ball by the shaped ring 28 and causes no further difficulties during the subsequent banding operation.

Having thus described the present invention by way of a practical embodiment thereof, modifications whereof will be apparent to those skilled in the art, what is claimed as new is as follows:

1. In a device for placing a ring-shaped band on a ball of yarn or the like wherein the band is placed on the ball by means of a first and a second band carrier mounted on a support which is displaceable with respect to the ball, the ball being held between the band carriers, the improvement comprising a guiding slideway on said support, means slidably supporting said first band carrier in said slideway, means rigidly attaching said second band carrier to said support, biasing means normally urging said first band carrier away from said second band carrier, power drive means reciprocating said first band carrier in said slideway relative to said second band carrier, and control means for said power drive means for moving said first band carrier towards said second band carrier during application of the band on said band carriers and after placing the band onto the ball, to thereby grip said ball, by displacement of said support carrying said band carriers, the ball being held between said band carriers during displacement of the support.

2. The improvement of claim 1 wherein said band carrier support is displaceable in a first direction for pushing a band onto the ball, and is displaceable in an opposite direction for withdrawing the ball from a winding mandrel with the ball held between said carriers.

3. The improvement of claim 1 wherein the band carriers are provided with barbs.

4. The improvement of claim 1 wherein said power drive means is a fluid operated piston-cylinder assembly.

5. The improvement of claim 4 wherein said piston-cylinder assembly comprises a pneumatic cylinder including a return spring for the piston.

6. The improvement of claim 1 wherein a shaping ring is coordinated with the band carriers for preforming the ball prior to placing the band thereon.

7. The improvement of claim 1 wherein said shaping ring is mounted on an arm extending from said band carrier support between said band carriers.

* * * * *

UNITED STATES PATENT AND TRADEMARK OFFICE

CERTIFICATE OF CORRECTION

PATENT NO. : 4,127,978

DATED : December 5, 1978

INVENTOR(S) : Florian Lucke

It is certified that error appears in the above-identified patent and that said Letters Patent are hereby corrected as shown below:

Col. 3, line 68, change "bank" to --band--.

Col. 6, line 7, change "1" to --6--.

Signed and Sealed this

*First* Day of *May 1979*

[SEAL]

*Attest:*

RUTH C. MASON
*Attesting Officer*

DONALD W. BANNER
*Commissioner of Patents and Trademarks*